US008052132B2

(12) United States Patent
Langenegger

(10) Patent No.: US 8,052,132 B2
(45) Date of Patent: Nov. 8, 2011

(54) METHOD AND ARRANGEMENT FOR PRODUCING AN ADHESIVE-BOUND PRINTED ITEM COMPOSED OF SEVERAL PRINTED PRODUCTS

(75) Inventor: Daniel Langenegger, Brittnau (CH)

(73) Assignee: Mueller Martini Holding AG, Hergiswil (CH)

( * ) Notice: Subject to any disclaimer, the term of this patent is extended or adjusted under 35 U.S.C. 154(b) by 818 days.

(21) Appl. No.: 11/889,272

(22) Filed: Aug. 10, 2007

(65) Prior Publication Data

US 2008/0038091 A1 Feb. 14, 2008

(30) Foreign Application Priority Data

Aug. 10, 2006 (EP) ..... 06405337

(51) Int. Cl.
*B65H 37/04* (2006.01)

(52) U.S. Cl. ..... 270/52.16; 270/52.14

(58) Field of Classification Search ..... 270/52.14, 270/52.16, 52.18, 52.19; 271/82, 85, 204, 271/206

See application file for complete search history.

(56) References Cited

U.S. PATENT DOCUMENTS

| | | | | |
|---|---|---|---|---|
| 5,005,815 | A | 4/1991 | Auksi | |
| 5,261,520 | A | 11/1993 | Duke | |
| 5,660,382 | A * | 8/1997 | Meier | 270/52.16 |
| 6,264,192 | B1 * | 7/2001 | Siebenmann et al. | 271/205 |
| 6,702,100 | B2 | 3/2004 | Studer | |
| 6,726,201 | B2 | 4/2004 | Studer | |
| 6,764,069 | B2 * | 7/2004 | Reist | 270/52.29 |
| 2003/0183999 | A1 * | 10/2003 | Reist | 270/52.14 |
| 2008/0232931 | A1 | 9/2008 | Hug et al. | |

FOREIGN PATENT DOCUMENTS

| | | |
|---|---|---|
| CA | 2 258 089 | 1/1998 |
| DE | 2016425 | 10/1971 |
| DE | 28 10 518 | 10/1978 |
| DE | 29 43 260 A1 | 5/1981 |
| DE | 10 2007 032 604 | 1/2008 |

(Continued)

OTHER PUBLICATIONS

European Search Report, dated Jan. 5, 2007, issued for counterpart European Application No. 06405337.4-2304 (w/English-language Translation).

(Continued)

*Primary Examiner* — Leslie A Nicholson, III

(74) *Attorney, Agent, or Firm* — Venable LLP; Robert Kinberg; Leigh D. Thelen

(57) ABSTRACT

An arrangement and method for producing an adhesive-bound, printed item composed of a number of printed products. A circulating conveyor includes a conveying track and a plurality of space-apart conveying units driven along the conveying track, wherein along a first conveying section of the circulating conveying printed products are gathered into loose book blocks in the conveying units which are positioned transverse to the conveying direction and in a reclined position that is inclined counter to the conveying direction. The circulating conveyor includes an additional conveying section to which the book blocks are supplied from the first conveying section for being conveyed to an adhesive binder. The additional conveying section is operative to accelerate the conveying units so that a divisional spacing between the book blocks is increased, and to pivot the conveying units so that the book blocks are moved to an upright position.

10 Claims, 1 Drawing Sheet

FOREIGN PATENT DOCUMENTS

| | | | |
|---|---|---|---|
| EP | 0 386 787 | A2 | 9/1990 |
| EP | 0 675 005 | B1 | 1/1995 |
| EP | 0 675 005 | A1 | 10/1995 |
| EP | 1 528 023 | A1 | 8/2004 |
| EP | 1 520 817 | | 4/2005 |
| EP | 1 712 495 | A2 | 4/2006 |
| EP | 1 669 312 | | 6/2006 |
| EP | 1 834 911 | | 9/2007 |
| EP | 1 886 832 | | 2/2008 |
| EP | 1 886 833 | | 2/2008 |
| FR | 2 206 748 | | 6/1974 |
| GB | 973639 | | 10/1964 |
| GB | 2 055 767 | A | 3/1981 |
| WO | WO-96/32293 | | 10/1996 |
| WO | WO 98/03422 | | 1/1998 |

OTHER PUBLICATIONS

European Search Report, dated Feb. 2, 2007, issued for counterpart European Application No. 06405338.2-1251 (w/English-language Translation).

U.S. Office Action, dated Jul. 19, 2010, issued in related U.S. Appl. No. 11/889,344.

Extended European Search Report dated Apr. 15, 2009, directed to a related European Patent Application No. EP 08405248.9, and an English-language translation.

Non-Final Office Action dated Mar. 9, 2011, issued in related U.S. Appl. No. 12/572,547.

* cited by examiner

METHOD AND ARRANGEMENT FOR PRODUCING AN ADHESIVE-BOUND PRINTED ITEM COMPOSED OF SEVERAL PRINTED PRODUCTS

CROSS-REFERENCE TO RELATED APPLICATIONS

This application claims the priority of European Patent Application No: 06405337.4-2304, filed on Aug. 10, 2006, the subject matter of which is incorporated herein by reference. Reference is additionally made to concurrently filed and co-owned Application No. Ser. No. 11/889,344 which is related to the subject matter herein and which is incorporated herein by reference in its entirety.

BACKGROUND OF THE INVENTION

The invention relates to a method for producing an adhesive-bound printed item composed of several printed products, for which the printed products are gathered into loose book blocks along a first conveying section of a conveying track for a circulating conveyor and are then supplied with the aid of a following conveying section to an adhesive binder. The invention furthermore relates to an arrangement for realizing said method.

With known methods used in the print processing industry for the adhesive binding of printed products to form printed items, the individual printed products are first gathered to form loose book blocks inside a gathering machine and are subsequently transferred to the conveying clamps of an adhesive binder. The transfer from the gathering machine to the adhesive binder among other things involves the function of taking over the gathered loose book blocks, which move at the speed and with the orientation of the gathering machine, and to transfer these book blocks to the adhesive binder at the speed of the adhesive binder.

According to one known machine of the above type, the book blocks are conveyed inside the gathering machine in the direction of the book block spine, meaning inside a channel with a V-shaped cross section that is inclined slightly toward the back folds. The book blocks are transferred while positioned in a vertical plane to the adhesive binder, which is also moving in a longitudinal direction, wherein the back folds of the book blocks are directed downward. In the gathering machine, the book blocks are normally conveyed form-fittingly and transferred with the aid of pushers attached to chains, which push along the book blocks. If the book blocks in the transfer region do not require any optional processing, for example vibrating, adding sections and gluing on end sheets, wire-stitching, printing, and the like, the book blocks only need to be moved from a slightly inclined position to an upright position during the conveying in the longitudinal direction of the spine. In the event that the gathering machine stops, the adhesive binder can continue the processing of the remaining book blocks inside the adhesive binder with the aid of a transfer element, which transfers the book blocks from the gathering chain of the gathering machine to a conveying chain for the intake area of the adhesive binder. The transfer element can furthermore be used to compensate for speed differences resulting from differences in the divisional spacing between the gathering machine and the adhesive binder. This solution is quite simple, but has the disadvantage that the printed products are conveyed in the direction of their greatest length. As a result, the spacing between successive book blocks of necessity increases and the conveying speed becomes relatively high. The conveying speed can thus form the maximum possible production speed. Above all, this is true for the channel region of the gathering machine in which air turbulence is generated as a result of the conveying operation, which then generates buoyancy forces in the uppermost printed products of the loose book block and can lift these off the book block. Another disadvantage manifests itself when the gathering machine is stopped because the loose book blocks shoot forward toward the next pusher as a result of their kinetic energy, thereby losing their orientation which can result in poor products or machine breakdowns.

According to a further known machine of the above type, the book blocks are gathered and conveyed inside a vertical channel, thus making it possible to omit the movement for putting the book blocks in the upright position. However, the aforementioned features and disadvantages apply in this case as well.

According to the disclosure in European Patent Application 0 675 005 B1, the loose book blocks are conveyed inside the adhesive binder while positioned transverse to the longitudinal spine direction. It is therefore conceivable to gather the printed products in the gathering machine while positioned transverse to the longitudinal direction and to subsequently transfer these to the adhesive binder moving in the transverse direction. As a result, the conveying speed can be reduced while the production speed is maintained, as compared to a conveying in the longitudinal direction of the spine. This solution has the disadvantage of a complicated design for the adhesive binder because a relative movement between the processing tools and the book blocks is necessary for some processing operations in the longitudinal spine direction.

According to another known machine, the printed sheets are gathered along a conveyor belt while positioned transverse to the longitudinal direction of the spine in an overlapping flow and are deposited one above the other. The individual book blocks are then separated out of the overlapping flow just prior to being transferred to an adhesive binder moving in the longitudinal direction. As disclosed in European Patent Application 1 528 023 A1, the book blocks can be transferred to laterally moving compartments following the separation and can be pivoted to the upright position, so that the book block spines are oriented in a downward direction. The book blocks can then be transferred with the aid of a 90° translational deflection to a conveyed flow moving in the longitudinal direction of the spine. This solution combines the advantages of a gathering machine, moving transverse to the longitudinal direction of the book block spine with the advantages of an adhesive binder moving in longitudinal direction of the spine. The disadvantage of this method, however, is that thicker book blocks, book blocks having a smaller format, and book blocks with a rigid content such as a CD-ROM, cannot be processed. The method furthermore restricts the positions that can be occupied by smaller printed products within a book block.

SUMMARY

It is an object of the present invention to take over a book block, conveyed continuously in a product flow with a first speed and while positioned transverse to its spine, in a back position that is inclined counter to the conveying direction, and to transfer this book block with a second speed in the longitudinal direction of its spine to transport clamps of an adhesive binder.

The above and other objects are accomplished according to the invention, wherein there is provided, in one embodiment, a method for producing adhesive-bound, printed items composed of a number of printed products, comprising: gathering printed products into loose book blocks along a first section of a circulating conveyor, the gathering being conducted while the printed products are positioned transverse to a conveying direction and in a reclined position that is inclined counter to the conveying direction; supplying the book blocks to an additional conveying section of the circulating conveyor, following the first section; accelerating the book blocks in the additional conveying section to achieve a greater divisional spacing between the book blocks; pivoting the book blocks to an upright position such that one side edge of the respective book blocks is in a position approximately parallel to the conveying direction; and lifting the book blocks up from the parallel position and transferring the book blocks to respective conveying clamps of an adhesive binder.

According to another aspect of the invention, there is provided an arrangement for producing an adhesive-bound, printed item composed of a number of printed products which, in one embodiment, comprises: a circulating conveyor comprising a conveying track and a plurality of space-apart conveying units driven along the conveying track in a conveying direction, the circulating conveyor further including: a first conveying section along which printed products are gathered into loose book blocks in the conveying units which are positioned transverse to the conveying direction and in a reclined position that is inclined counter to the conveying direction, and an additional conveying section to which the book blocks are supplied from the first conveying section for being conveyed to an adhesive binder; wherein the additional conveying section is operative to accelerate the conveying units so that a divisional spacing between the book blocks is increased, and to pivot the conveying units so that the book blocks are moved to an upright position.

BRIEF DESCRIPTION OF THE DRAWINGS

These and other features and advantages of the invention will be further understood from the following detailed description of embodiments of the invention with reference to the accompanying drawing.

DETAILED DESCRIPTION

Figure 1:
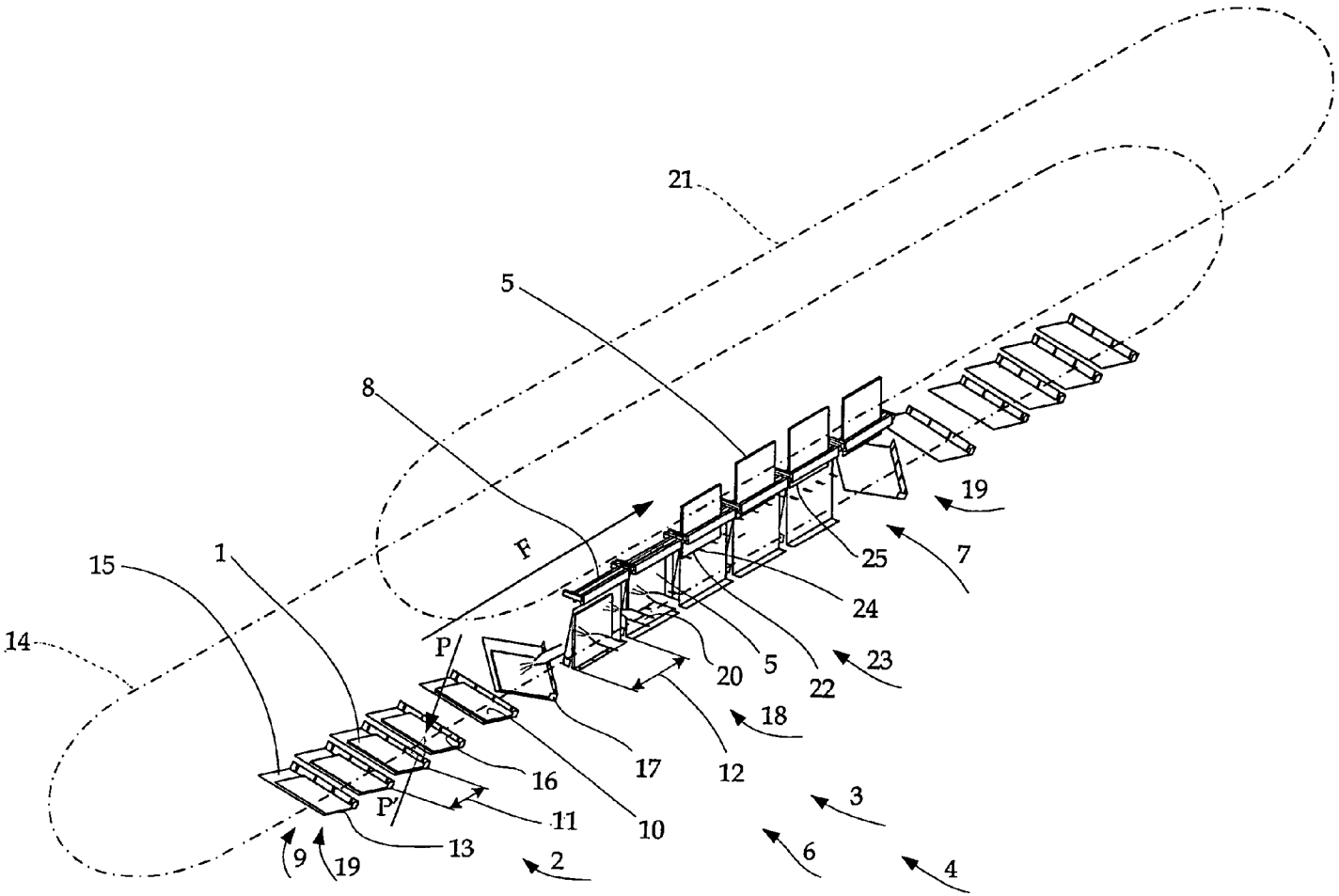
FIG. 1 shows a simplified representation of an adhesive binder according to the invention.

Referring to FIG. 1, there is shown a circulating conveyor 4 with which printed products 1 are gathered into loose book blocks 5 along a first conveying section 2 of a conveying track 6. The conveyor 4 consists of several successively arranged conveying units 19, which can move along a closed guide path 14. Each conveying unit 19 can be moved individually, thus making it possible to vary the speed and the spacing between the conveying units 19 along the guide path 14. A conveying unit 19 essentially comprises a table 15, an end stop 16 that is positioned perpendicular to the table, and a side end stop 17 for holding the printed products 1, which is positioned perpendicular to the end stop 16. The side end stop 17 is only needed during the gathering operation and is designed such that it can be moved out of the end side region 13 for the printed products 1. The conveying units 19 can be pivoted around at least one axis, relative to the conveying direction F. The conveying units 19 are arranged along the first conveying section 2, in a back, or reclined, position that is inclined counter to the conveying direction F and such that they are positioned at a slight downward angle relative to the side end stop 17. As a result, the printed products 1 and/or the book blocks 5 rest with one flat side 9 on the table 15, with one side edge 22 against the end stop 16, and with the end side region 13 against the side end stop 17. Sheet feeders (not shown herein), which are arranged along the guide path 14, supply the conveying units 19 in a manner known per se with printed products 1, such that the conveying units 19 hold complete, loose book blocks 5 at the end of the first conveying section 2, which rest along three sides against the conveying units 19 because of their inherent weight, and thus are aligned with the conveying units 19 along three sides. To reduce the slip stream effect, the divisional spacing 11 between successive conveying units 19 is kept as small as possible in the first conveying section 2.

In an additional section 3 which follows section 2 of circulating conveyor 4, the book blocks are transferred to conveying clamps 8 that move along a circulating path 21 of a downstream installed adhesive binder 7. As compared to the conveying section 2, the book blocks 5 held by the conveying clamps 8 that move along a circulating path 21 have a different orientation and the divisional spacing 12 is increased. The side edges 22 of the printed products 1, which previously rested against the end stops 16, now point in downward direction and form a book block spine 25 while the flat sides 9, 10 are positioned in vertical planes, parallel with the direction of conveyance.

The book blocks 5 must be accelerated along the additional conveying section 3 in order to increase the divisional spacing 12 and must be pivoted to an upright position, in which they are approximately parallel to the conveying direction F. From this position, they can be lifted up and transferred with the aid of lifting devices 24 to the conveying clamps 8 of the adhesive binder 7. At least during the lifting up of the book blocks 5 to be transferred to the conveying clamps 8, in an end region 23 of the additional conveying section 3, the conveying units 19 move at the same speed and in the same direction as the conveying direction F for the circulating conveying clamps 8 of the adhesive binder 7. Once the book blocks 5 are held in place by the conveying clamps 8, the conveying units 19 are moved back to the starting position that is required for the gathering process, relative to the orientation of the conveying direction F, wherein the conveying units 19 must again be spaced apart at the smaller divisional spacing 11 by the start of the gathering process.

At least near the end of the first conveying section 2, a force P, P', which may be generated, for example, by blast air nozzles, acts upon the book blocks 5, thereby causing them to rest with their flat sides 9, 10 against the conveying unit 19. This is necessary to keep the book blocks 5 in the conveying units 19 from being displaced during the acceleration and/or pivoting movements. A holding device 18 is furthermore provided on the side opposite the tables 15, which is activated to hold the flat sides 10 of the book blocks 5 against the tables 15, at least at the start of the acceleration and/or pivoting movement. The holding device 18 may comprise of a plurality of blast air feeding nozzles 20, which are arranged along the second conveying section 3 and press the book blocks with blast air against the tables 15. Alternatively, a sliding device may be used to press the book blocks against the tables 15.

It will be understood that the above description of the present invention is susceptible to various modifications, changes and adaptations, and that the same are intended to be comprehended within the meaning and range of equivalents of the appended claims.

What is claimed is:

1. A method for producing adhesive-bound, printed items composed of a number of printed products, comprising:

gathering printed products into loose book blocks along a first section of a circulating conveyor, the gathering being conducted while the printed products are positioned transverse to a conveying direction and in a reclined position that is inclined counter to the conveying direction;

supplying the book blocks to an additional conveying section of the circulating conveyor, following the first section;

accelerating the book blocks in the additional conveying section to achieve a greater divisional spacing between the book blocks;

pivoting the book blocks to an upright position such that one side edge of the respective book blocks is in a position approximately parallel to the conveying direction; and lifting the book blocks up from the parallel position and transferring the book blocks to respective conveying clamps of an adhesive binder.

2. The method according to claim 1, further including the step of positioning the one side edge to form a spine of the book block after pivoting the book blocks to an upright position.

3. The method according to claim 1, including exerting a force onto flat sides of the book blocks at least near the end of the first conveying section to hold the book blocks in place.

4. The method according to claim 3, wherein the exerting step includes exerting the force onto the flat sides of the book blocks prior to the acceleration or pivoting of the book blocks.

5. An arrangement for producing an adhesive-bound, printed item composed of a number of printed products, comprising:

a circulating conveyor comprising a conveying track and a plurality of spaced-apart conveying units driven along the conveying track in a conveying direction, the circulating conveyor further including:

a first conveying section along which printed products are gathered into loose book blocks in the conveying units which are positioned transverse to the conveying direction and in a reclined position that is inclined counter to the conveying direction; and an additional conveying section to which the book blocks are supplied from the first conveying section for being conveyed to an adhesive binder, wherein the additional conveying section is operative to accelerate the conveying units so that a divisional spacing between the book blocks is increased, and to pivot the conveying units so that the book blocks are moved to an upright position, wherein the conveying units include lifting devices.

6. The arrangement according to claim 5, and further including circulating conveying clamps arranged above the additional section of the circulating conveyor and driven in a conveying direction and at a conveying speed, wherein the book blocks are lifted up and transferred to the conveying clamps from the conveying units in the additional section, and wherein the additional section is driven so that the conveying units move at least during the operation of lifting up the book blocks for the transfer to the conveying clamps at the same speed and in the same direction as the circulating conveying clamps.

7. The arrangement according to claim 6, wherein the conveying units are adapted to hold the printed products and/or the loose book blocks.

8. An arrangement for producing an adhesive-bound, printed item composed of a number of printed products, comprising:

a circulating conveyor comprising a conveying track and a plurality of spaced-apart conveying units driven along the conveying track in a conveying direction, the circulating conveyor further including:

a first conveying section along which printed products are gathered into loose book blocks in the conveying units which are positioned transverse to the conveying direction and in a reclined position that is inclined counter to the conveying direction; and an additional conveying section to which the book blocks are supplied from the first conveying section for being conveyed to an adhesive binder, wherein the additional conveying section is operative to accelerate the conveying units so that a divisional spacing between the book blocks is increased, and to pivot the conveying units so that the book blocks are moved to an upright position; and a holding device installed along the additional conveying section to act upon the loose book blocks, wherein the holding device comprises blast air feeding nozzles.

9. The arrangement according to claim 8, and further including circulating conveying clamps arranged above the additional section of the circulating conveyor and driven in a conveying direction and at a conveying speed, wherein the book blocks are lifted up and transferred to the conveying clamps from the conveying units in the additional section, and wherein the additional section is driven so that the conveying units move at least during the operation of lifting up the book blocks for the transfer to the conveying clamps at the same speed and in the same direction as the circulating conveying clamps.

10. The arrangement according to claim 9, wherein the conveying units are adapted to hold the printed products and/or the loose book blocks.

* * * * *